US009833913B2

(12) United States Patent
Jang et al.

(10) Patent No.: US 9,833,913 B2
(45) Date of Patent: Dec. 5, 2017

(54) GRAPHENE COMPOSITE HAND-HELD AND HAND-HEATED THAWING TOOL

(71) Applicant: Nanotek Instruments, Inc., Dayton, OH (US)

(72) Inventors: Bor Z. Jang, Centerville, OH (US); Aruna Zhamu, Centerville, OH (US)

(73) Assignee: Nanotek Instruments, Inc., Dayton, OH (US)

( * ) Notice: Subject to any disclaimer, the term of this patent is extended or adjusted under 35 U.S.C. 154(b) by 538 days.

(21) Appl. No.: 13/694,722

(22) Filed: Dec. 28, 2012

(65) Prior Publication Data

US 2014/0182830 A1 Jul. 3, 2014

(51) Int. Cl.

| | |
|---|---|
| ***F28F 21/02*** | (2006.01) |
| ***B26B 3/02*** | (2006.01) |
| ***A47G 21/00*** | (2006.01) |

(52) U.S. Cl.

CPC ..... *B26B 3/02* (2013.01); *A47G 21/00* (2013.01); *F28F 21/02* (2013.01)

(58) Field of Classification Search

CPC ..... F28F 21/02; F28F 21/006; F28F 21/06; F28F 21/08; F28F 21/081; F28F 21/089

USPC ..... 165/185

See application file for complete search history.

(56) References Cited

U.S. PATENT DOCUMENTS

| | | | | |
|---|---|---|---|---|
| 7,071,258 | B1 | 7/2006 | Jang et al. | |
| 2005/0271574 | A1 | 12/2005 | Jang et al. | |
| 2006/0035085 | A1* | 2/2006 | Ozaki | B82Y 30/00 428/408 |
| 2007/0158050 | A1* | 7/2007 | Norley et al. | 165/80.4 |
| 2009/0173334 | A1* | 7/2009 | Krs et al. | 126/569 |
| 2010/0128439 | A1* | 5/2010 | Tilak et al. | 361/709 |
| 2011/0183025 | A1* | 7/2011 | Funka, Jr. | 425/279 |
| 2014/0147648 | A1 | 5/2014 | Zhamu et al. | |

FOREIGN PATENT DOCUMENTS

| | | | |
|---|---|---|---|
| DE | 3918140 | * | 4/1989 |
| DE | 202005001198 | * | 6/2005 |
| JP | H10168502 | * | 6/1998 |

OTHER PUBLICATIONS

Grippa, DE3918140TRANS (English Translation), Apr. 1989.*
Aronsky, DE202005001198TRANS (English Translation), Jun. 2005.*
Matsui, JPH10168502TRANS (English Translation), Jun. 1998.*
U.S. Appl. No. 10/858,814, filed Jun. 3, 2004, B. Z. Jang, et al.
U.S. Appl. No. 13/694,356, filed Nov. 26, 2012, A. Zhamu, et al.

* cited by examiner

*Primary Examiner* — Justin Jonaitis
*Assistant Examiner* — Eric Ruppert

(57) ABSTRACT

The present invention provides a hand-held and hand-heated thawing tool comprising a handling portion and a functional portion wherein one or both portions comprises a composite material comprising 1-90% by weight of a conductivity-enhancing graphene phase dispersed in or bonded by a matrix material of 10-99% by weight based on a total composite weight, and wherein the handling portion, when being held by a human hand, transfers heat from the hand to the functional portion for thawing or melting a food item, such as butter and ice cube. By holding such a tool, a person can use his or her own body heat to rapidly thaw a slice of butter, or melt and cut through a block of ice without the assistance of any other heating tool (e.g. an oven).

13 Claims, 3 Drawing Sheets

GRAPHENE COMPOSITE HAND-HELD AND HAND-HEATED THAWING TOOL

FIELD OF THE INVENTION

The present invention provides a thermally conductive composite tool that transfers heat from a human body to an intended object for thawing this object (e.g. butter or ice).

BACKGROUND

Butter, margarine, and related products, such as "spreads", are commonly stored in a refrigerator, freezer, or cooled location. When served with a solid piece of butter or margarine, one would want to enjoy the food as soon as possible. One would want to quickly spread butter or margarine on bread surfaces, for instance. However, one usually finds it difficult to cut a slice of cold butter or margarine just taken out of a frigid or cool place and spread it over a piece of bread or toast. This is a frustrating experience that has bothered billions of people for probably hundreds of years.

Of course, presumably one can use a microwave oven to heat up the butter/margarine block, but the entire piece would get melted and this might not be a desirable outcome. We often want to thaw and spread one slice of butter/margarine at a time. Further, a microwave oven is not readily available in many locations (e.g. inside a car or during air travel). It is highly desirable to have a handy tool to readily and easily cut and thaw a slice of butter/margarine, preferably without the help from an external heat source.

Thus, it is an object of the present invention to provide a handheld and hand-heated thawing tool (e.g. a knife-shape kitchenware) that is readily available for slicing and thawing butter/margarine.

It is a specific object of the present invention to provide a handheld and hand-heated thawing tool that receives heat from a human body (e.g. through a hand that holds this tool), rapidly transfers heat to a food item (e.g. butter), and helps to thaw the otherwise rigid object.

SUMMARY OF THE INVENTION

The present invention provides a hand-held and hand-heated thawing tool comprising a handling portion and a functional portion wherein one or both portions comprises a composite material comprising a conductivity-enhancing graphene phase of 1-90% by weight dispersed in or bonded by a matrix material of 10-99% by weight based on a total composite weight, and wherein the handling portion, when being held by a human hand, transfers heat from the hand to the functional portion for thawing or melting an object (e.g., a food item such as butter, margarine, or even ice cube).

The graphene phase contains a graphene material that may be selected from pristine graphene, graphene oxide, reduced graphene oxide, doped graphene, nitrogenated graphene, hydrogenated graphene, halogenated graphene, CVD graphene (graphene produced by chemical vapor deposition), functionalized graphene, unitary graphene, or graphene single crystal. The graphene phase has a thermal conductivity preferably and typically greater than 1,000 W/mK, more preferably greater than 2,000 W/mK, and most preferably greater than 3,000 W/mK. The resulting composite material has a thermal conductivity greater than 300 W/mK, more commonly and preferably greater than 500 W/mK, and more preferably greater than 1,000 W/mK.

The matrix material is selected from a metal, a polymer, a glass, a carbon, a ceramic material, or a combination thereof. Preferably, the matrix material comprises steel, aluminum, copper, zinc, or tin, but aluminum alloy or stainless steel is most preferred.

The hand-held and hand-heated thawing tool is surprisingly capable of rapidly receiving heat from a human body (e.g. hand) in such a manner that the functional portion can reach a temperature of at least 30° C. when the handling portion is held by a human hand for 10 seconds or less. In many cases, the functional portion reaches a temperature of at least 34° C. when the handling portion is held by a human hand for 10 seconds or less. In general, the functional portion reaches a temperature sufficient to thaw the object (e.g. butter) when the handling portion is held by a human hand for 10 seconds or less. Quite often, the functional portion reaches a temperature sufficient to thaw the object when the handling portion is held by a human hand for 5 seconds or less.

In a preferred embodiment, the hand-held and hand-heated thawing tool is a composite material that has a skin zone and a core zone and the skin zone is a graphene-rich zone having a higher graphene proportion than the core zone. The skin zone is preferably less than 50% by volume (more preferably less than 20%) of the total tool volume. Alternatively, it is also possible to design and construct a hand-held and hand-heated thawing tool in such a manner that the tool has a skin zone and a core zone and the skin zone is a graphene-poor zone having a lower graphene proportion than the core zone. This is the case if one desires to have a metallic skin, e.g., steel or aluminum alloy commonly used for making a table knife, spoon, or other kitchen hardware.

In another preferred embodiment, the hand-held and hand-heated thawing tool may be designed to contain a composite material that further comprises a thermally conductive additive selected from graphite particle, expanded graphite flake, flexible graphite sheet, pyrolytic graphite, carbon black, acetylene black, activated carbon, meso-phase carbon, needle coke, meso-phase carbon, carbon fiber, graphite fiber, carbon nano-fiber, graphitic nano-fiber, carbon nano-tube, metal particles, metal fiber, metal nano-wire, or a combination thereof.

The present invention also provides a hand-held and hand-heated thawing tool comprising a handling portion and a functional portion wherein one or both portions comprises a composite material comprising a conductivity-enhancing carbon or graphite phase of 1-90% by weight dispersed in or bonded by a matrix material of 10-99% by weight based on a total composite weight, and wherein the handling portion, when being held by a human hand, transfers heat from the hand to the functional portion for thawing or melting an object. The carbon or graphite phase is selected from graphite particle, expanded graphite flake, flexible graphite sheet, pyrolytic graphite, carbon black, acetylene black, activated carbon, meso-phase carbon, needle coke, meso-phase carbon, carbon fiber, graphite fiber, carbon nano-fiber, graphitic nano-fiber, carbon nano-tube, a combination thereof, or a combination with a metal particle, metal fiber, or metal nano-wire. The matrix material may be selected from a metal, a polymer, a glass, a carbon, a ceramic material, or a combination thereof. The tool or composite material has a skin zone and a core zone and the skin zone has a higher carbon or graphite proportion than said core zone.

DETAILED DESCRIPTION OF PREFERRED EMBODIMENTS

Figure 1:
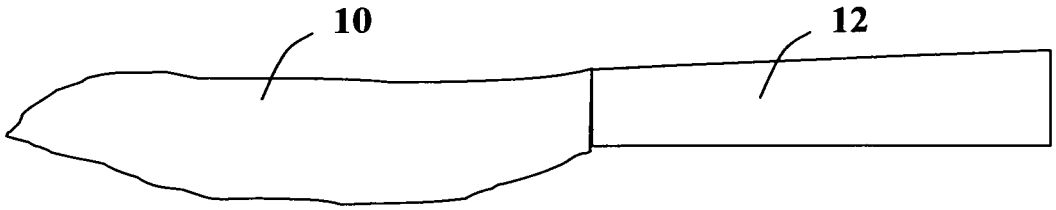
FIG. 1 Schematic of a hand-held and hand-heated thawing tool consisting of a handling or holding portion 12 and a functional or thawing portion 10.

The present invention provides a hand-held and hand-heated thawing tool that receives heat from a human body through, for instance, a hand that holds this tool. The heat is transmitted from one portion (handling portion) of the tool to another portion (functional or thawing portion) to help thaw an object (e.g. a food item such as butter, margarine, or ice cube). The tool comprises a handling portion and a functional portion wherein one or both portions comprises a composite material comprising 1-90% by weight of a conductivity-enhancing graphene phase dispersed in or bonded by a matrix material of 10-99% by weight based on the total composite weight. The handling portion, when being held by a human hand, transfers heat from the hand to the functional portion for thawing or melting an object.

This thawing tool can be a type of tableware, such as a knife, butter spreader, spoon, or fork, just to name a few as examples. By using one hand to hold the handling portion of a graphene composite knife of the present invention, one supplies heat from the hand to the handling portion. The heat constantly supplied from the hand rapidly flows to the functional portion, which thaws an ice cube or a slice of butter on contact. This is most surprising since conventional tableware, e.g. stainless steel or aluminum alloy knife, is not known to be capable of thawing a food item when the knife is being held by a human hand.

In a thawing tool of the present invention, there are at least a thermal conductivity-enhancing phase (also referred to as a reinforcing phase or reinforcement) and a matrix phase (or binder phase); the latter being typically a continuous phase. The former (reinforcement) can be either a continuous phase or a dispersed or discrete phase. The matrix material is selected from a metal, a polymer, a glass, a carbon, a ceramic material, or a combination thereof. Preferably, the matrix material comprises steel, aluminum, zinc, or tin, but aluminum alloy or stainless steel is most preferred.

In a preferred embodiment of the present invention, the hand-held and hand-heated thawing tool is made from a composite material that comprises a new class of nano material, graphene, as a thermal conductivity-enhancing phase. In another embodiment, this graphene-reinforced composite can further contain another thermally conductive additive as a conductivity-enhancing phase material. This additive may be selected from the graphite particle, expanded graphite flake, flexible graphite sheet, pyrolytic graphite, carbon black, acetylene black, activated carbon, meso-phase carbon, needle coke, meso-phase carbon, carbon fiber, graphite fiber, carbon nano-fiber, graphitic nano-fiber, carbon nano-tube, metal particles, metal fiber, metal nano-wire, or a combination thereof. In yet another preferred embodiment, any of the aforementioned carbon or graphite material can be used alone, without the presence of a graphene material, as a thermal conductivity-enhancing phase. However, after an extensive and in-depth study, we observed that graphene is the most effective conductivity enhancer phase, capable of rapidly transferring heat from a human hand to thaw a variety of food items with a minimal heat loss to the surrounding.

In order to further illustrate the presently invented thawing tool, we will use a few examples of the object to be thawed by the tool. As a first example, butter served on a dinning table is typically available as a block wrapped by a sheet of casing paper/plastic or supported by a plate or shallow container. One typically has to use a knife to slice out a small piece of butter at a time and spread it onto a food item such as a piece of bread. We all know that it is not easy or convenient to slice and spread butter that is just taken out of a refrigerator.

Butter is typically made from cream, produced by cows, and by law in the USA, has a butterfat content of at least 80%. However, some premium butter grades on the market have 81% up to 85% butterfat. Water, milk solids, and salt make up the rest, and the amount of salt in salted butter ranges from 1.5% to 3%. The relative proportions of these solid contents dictate the melting point or thawing temperature of a particular type of butter.

As a second example, margarine is made from vegetable oil (e.g. corn oil or soybean oil), although it can contain some beef fat (suet) flavored with milk. Vegetable oils are liquid at room temperature, but a hydrogenation process makes them solid at room temperature. Like butter, margarine is 80% fat and 20% water and solids, of which about 3% is salt. It is often flavored with skim milk or a synthetically produced chemical compound that mimics the flavor of butter. It is sometimes fortified with vitamins A and D to match the nutritional make-up of butter, and includes salt, artificial color, and preservatives. The relative proportions of these solid contents dictate the melting point or thawing temperature of a particular type of margarine.

Most solid fats do not melt suddenly at a precise point, but do so gradually over a range of 10 to 20 degrees. There are different compounds with different characteristics in most fats, and these melt at different temperatures. Thus, instead of transforming instantly from a solid to a liquid, certain compounds melt at a lower temperature, weakening the overall structure. Eventually, all of the compounds melt and the entire piece of butter looks and behaves like a liquid. The typical melting point of butter is between 90° F. and 95° F. (32° C. and 35° C.). The melting point of margarine appears to be a little bit warmer, at 94° F. to 98° F. (34° C. to 37° C.). But margarines can be formulated to have melting points ranging from 91° F. to 109° F. (33° C. to 43° C.). Many of the higher-melting-point margarines are manufactured for the baking industry. The presence of salt lowers the melting point of both butter and margarine.

The third example is "spreads." Spreads do not have a specific amount of fat in them (some are as much as 50% water), and their melting points are all over the map. Because they are so inconsistent, they are not reliable for cooking. Nothing in the vegetable-oil/margarine kingdom can truly match the flavor of butter—although some come quite close. Butter is not well suited to frying, because the milk solids burn at a low temperature. The milk solids can be removed by clarifying the butter, though, which makes it a tasty and indulgent medium for frying. Margarine, again, with 20% mystery ingredients, is also not a great choice for frying. But in cooking tasks, most recipes let you use butter or margarine interchangeably, and with recipes that do specify butter exclusively, people who prefer margarine generally use it anyway.

The fourth example of the object to be thawed by the presently invented hand-heated thawing tool is ice, which has a melting point of 0° C.

By holding an aluminum or steel knife on the handling end even for up to 10 minutes, we found that the opposite end did not exhibit a temperature sufficient to thaw a slice of butter that was just removed from a refrigerator. It seems that a majority of the heat received from a human hand was lost or dissipated into open air, possibly through radiation and convection, before the heat reaches the opposite end. We decided to investigate the use of a carbon or graphite-based conductivity-enhancer to improve the thermal characteristics of the metal silverware. Several types of carbon or graphite materials have been studied, which are described below:

Carbon is known to have five unique crystalline structures, including diamond, fullerene (0-D nano graphitic material), carbon nano-tube (1-D nano graphitic material), graphene (2-D nano graphitic material), and graphite (3-D graphitic material).

The carbon nano-tube (CNT) refers to a tubular structure grown with a single wall or multi-wall. Carbon nano-tubes have a diameter on the order of a few nanometers to a few hundred nanometers. Its longitudinal, hollow structure imparts unique mechanical, electrical and chemical properties to the material. CNT is a 1-D (one-dimensional) nano carbon or 1-D nano graphite material. A carbon nano-fiber (CNF) may be considered as a larger-diameter variant of a CNT.

Bulk natural flake graphite is a 3-D graphitic material with each particle being composed of multiple grains (or graphite single crystals or crystallites) with grain boundaries (amorphous or defect zones) demarcating neighboring graphite single crystals. Each grain is composed of multiple graphene planes oriented parallel to one another. A graphene plane in a graphite crystallite is composed of carbon atoms occupying a two-dimensional, hexagonal lattice. In a given grain or single crystal, the graphene planes are stacked and bonded via van der Waal forces in the crystallographic c-direction (perpendicular to the graphene plane or basal plane). Although all the graphene planes in one grain are parallel to one another, typically the graphene planes in one grain and the graphene planes in an adjacent grain are different in orientation. In other words, the orientations of the various grains in a graphite particle typically differ from one grain to another.

A graphite single crystal (crystallite) per se is anisotropic with a property measured along a direction in the basal plane (crystallographic a- or b-axis direction) being dramatically different than if measured along the crystallographic c-axis direction (thickness direction). For instance, the thermal conductivity of a graphite single crystal can be up to approximately 1,920 W/mK (theoretical) or 1,800 W/mK (experimental) in the basal plane (crystallographic a- and b-axis directions), but that along the crystallographic c-axis direction is less than 10 W/mK (typically less than 5 W/mK). Consequently, a natural graphite particle composed of multiple grains of different orientations exhibits an average property between these two extremes. It would be highly desirable in many applications to produce a bulk graphite particle (containing single or multiple grains) having sufficiently large dimensions and having all graphene planes being essentially parallel to one another along one desired direction. For instance, it is highly desirable to have one large-size graphite particle (e.g. a unitary layer of multiple graphene planes) having the c-axis directions of all the graphene planes being substantially parallel to one another) and having a sufficiently large length/width for a particular application (e.g. >30 $cm^2$ for use as a thermal conductivity-enhancing phase of a thawing tool). Thus far, it has not been possible to produce this type of large-size unitary graphene entity from existing natural or synthetic graphite particles.

The constituent graphene planes of a graphite crystallite can be extracted or isolated from a graphite crystallite to obtain individual graphene sheets of carbon atoms. An isolated, individual graphene sheet is commonly referred to as single-layer graphene. A stack of multiple graphene planes bonded through van der Waals forces in the thickness direction with an inter-graphene plane spacing of approximately 0.335 nm is commonly referred to as a multi-layer graphene. A multi-layer graphene platelet has up to 300 layers of graphene planes (<100 nm in thickness), but more typically up to 30 graphene planes (<10 nm in thickness), even more typically up to 20 graphene planes (<7 nm in thickness), and most typically up to 10 graphene planes (commonly referred to as few-layer graphene in scientific community). Single-layer graphene and multi-layer graphene sheets are collectively called "nano graphene platelets" (NGPs). Graphene or NGP is a new class of carbon nano material (a 2-D nano carbon) that is distinct from the 0-D fullerene, the 1-D CNT, and the 3-D graphite.

Our research group pioneered the development of graphene materials and related production processes as early as 2002: (1) B. Z. Jang and W. C. Huang, "Nano-scaled Graphene Plates," U.S. Pat. No. 7,071,258 (Jul. 4, 2006), application submitted in October 2012; (2) B. Z. Jang, et al. "Process for Producing Nano-scaled Graphene Plates," U.S. patent application Ser. No. 10/858,814 (Jun. 3, 2004); and (3) B. Z. Jang, A. Zhamu, and J. Guo, "Process for Producing Nano-scaled Platelets and Nanocomposites," U.S. patent application Ser. No. 11/509,424 (Aug. 25, 2006).

Figure 3:
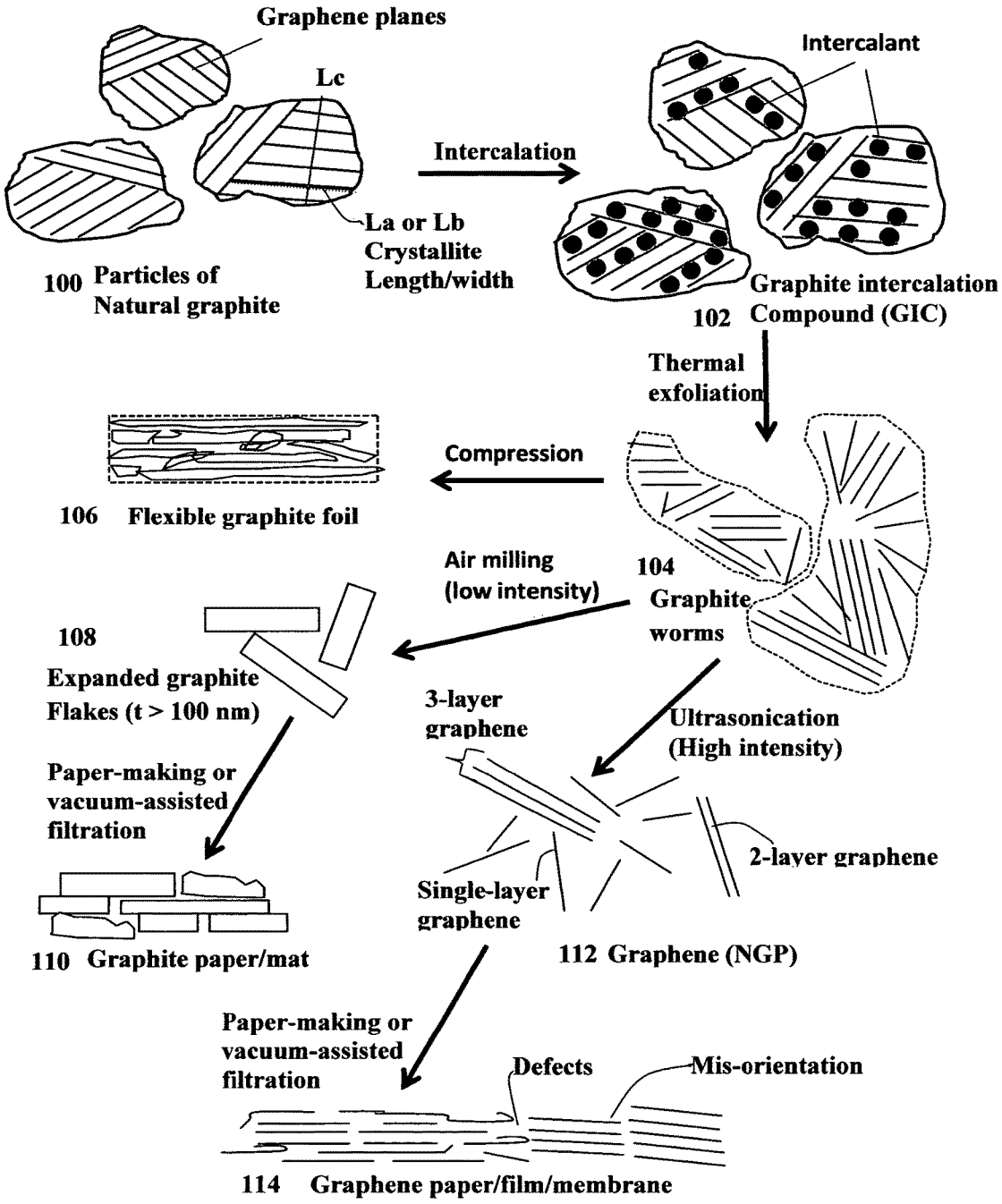
FIG. 3 Schematic drawing illustrating the processes for producing exfoliated graphite (graphite worms), expanded graphite, graphene platelets, graphite or graphene oxide paper, mat, film, and membrane of simply aggregated flakes/platelets. All processes begin with intercalation and/or oxidation treatment of graphitic materials (e.g. natural graphite particles).

NGPs are typically obtained by intercalating natural graphite particles with a strong acid and/or oxidizing agent to obtain a graphite intercalation compound (GIC) or graphite oxide (GO), as illustrated in FIG. 3. This is most often accomplished by immersing natural graphite powder (100 in FIG. 3) in a mixture of sulfuric acid, nitric acid (an oxidizing agent), and another oxidizing agent (e.g. potassium permanganate or sodium chlorate). The resulting GIC (102) is actually some type of graphite oxide (GO) particles. This GIC is then repeatedly washed and rinsed in water to remove excess acids, resulting in a graphite oxide suspension or dispersion, which contains discrete and visually discernible graphite oxide particles dispersed in water. There are two processing routes to follow after this rinsing step:

Route 1 involves removing water from the suspension to obtain "expandable graphite," which is essentially a mass of dried GIC or dried graphite oxide particles. Upon exposure of expandable graphite to a temperature in the range of typically 800-1,050° C. for approximately 30 seconds to 2 minutes, the GIC undergoes a rapid expansion by a factor of 30-300 to form "graphite worms" (104), which are each a collection of exfoliated, but largely un-separated or still interconnected graphite flakes.

In Route 1A, these graphite worms (exfoliated graphite or "networks of interconnected/non-separated graphite flakes") can be re-compressed to obtain flexible graphite sheets or foils (106) that typically have a thickness in the range of 0.125 mm (125 μm)-0.5 mm (500 μm). One may choose to use a low-intensity air mill or shearing machine to simply break up the graphite worms for the purpose of producing the so-called "expanded graphite flakes" (108) which contain mostly graphite flakes or platelets thicker than 100 nm (hence, not a nano material by definition). Expanded graphite flakes may be formed into a porous preform, such as paper or mat 110.

Exfoliated graphite worms, expanded graphite flakes, and the recompressed mass of graphite worms (commonly referred to as flexible graphite sheet or flexible graphite foil) are all 3-D graphitic materials that are fundamentally different and patently distinct from either the 1-D nano carbon material (CNT) or the 2-D nano carbon material (graphene).

Flexible graphite (FG) foils can be used as a heat spreader material, but exhibiting a maximum in-plane thermal conductivity of typically less than 500 W/mK (more typically <300 W/mK) and in-plane electrical conductivity no greater than 1,500 S/cm. These low conductivity values are a direct result of the many defects, wrinkled or folded graphite flakes, interruptions or gaps between graphite flakes, and non-parallel flakes. Many flakes are inclined with respect to one another at a very large angle (e.g. mis-orientation of 20-40 degrees).

In Route 1B, the exfoliated graphite is subjected to high-intensity mechanical shearing (e.g. using an ultrasonicator, high-shear mixer, high-intensity air jet mill, or high-energy ball mill) to form separated single-layer and multi-layer graphene sheets (collectively called NGPs, 112), as disclosed in our U.S. application Ser. No. 10/858,814. Single-layer graphene can be as thin as 0.34 nm, while multi-layer graphene can have a thickness up to 100 nm. In the present application, the thickness of multi-layer NGPs is typically less than 20 nm.

Route 2 entails ultrasonicating the graphite oxide suspension for the purpose of separating/isolating individual graphene oxide sheets from graphite oxide particles. This is based on the notion that the inter-graphene plane separation has been increased from 0.335 nm in natural graphite to 0.6-1.1 nm in highly oxidized graphite oxide, significantly weakening the van der Waals forces that hold neighboring planes together. Ultrasonic power can be sufficient to further separate graphene plane sheets to form separated, isolated, or discrete graphene oxide (GO) sheets. These graphene oxide sheets can then be chemically or thermally reduced to obtain "reduced graphene oxides" (RGO) typically having an oxygen content of 0.001%-10% by weight, more typically 0.01%-5% by weight. GO, RGO, or pristine graphene platelets can be made into a paper or mat form 114.

For the purpose of defining the claims of the instant application, NGPs include single-layer and multi-layer graphene or reduced graphene oxide with an oxygen content of 0-10% by weight, more typically 0-5% by weight, and preferably 0-2% weight. Pristine graphene has essentially 0% oxygen. Graphene oxide (including RGO) can have 0.001%-46% by weight of oxygen. In addition to pristine graphene, graphene oxide, and reduced graphene oxide, other graphene materials suitable for use as a thermal conductivity-enhancing phase include doped graphene (e.g. doped by boron, nitrogen, etc.), nitrogenated graphene, hydrogenated graphene or "graphane," halogenated graphene (e.g. graphene fluoride), and functionalized graphene. We have found that these graphene materials all exhibit highly desirable thermal properties for the present purpose.

In one preferred embodiment of the present invention, the hand-held thawing tool contains a composite having discrete particles of a graphene material or NGP as a thermal conductivity-enhancing phase. These discrete graphene particles (nano graphene platelets or sheets) can be incorporated as a thermal conductivity-enhancing phase in the presently invented composite tool in many different manners. For instance, these discrete platelets or sheets can be directly mixed with a resin melt or polymer-solvent solution to form a composite via various composite molding processes, such as compression molding, extrusion, injection molding, reaction injection molding, and casting. The graphene platelets or sheets can also be mixed with a matrix material (metal, glass, carbon, ceramic, etc.) to form a composite through melt casting, molding, powder sintering, etc.

As a preferred processing technique, one may shape multiple discrete graphene platelets or sheets into a form of paper, mat, veil, or other porous preform structure, which is essentially a network of electron- and phonon-conducting paths. This porous network is then infiltrated with a binder material, such as a resin, metal, or carbon. In a further preferred embodiment, the surface of a graphene mat, paper, or veil may be deposited with a layer of matrix or binder material (such as aluminum or steel). This can be accomplished by using many different deposition processes, such as electrochemical deposition (including electro-plating), chemical vapor deposition (CVD), chemical vapor infiltration (CVI), physical vapor deposition (PVD), sputtering, solution filtration, etc.

Alternatively, the graphene material for use in a thawing tool is a continuous film herein referred to as a unitary graphene layer or graphene single crystal, which is derived from graphene oxide gel. The graphene oxide gel, to be described in detail later, typically contains 20-46% by weight oxygen immediately after removal of the liquid from the GO gel, but prior to a subsequent heat treatment. The graphene oxide gel-derived unitary graphene layer or graphene single crystal for use as a thermal conductivity enhancer of the present invention typically has an oxygen content of 0.01% to 5% by weight, more typically <<2% by weight. The GO gel may be cast into a thin film on a solid substrate, which is followed by removal of liquid from the gel and heat-treatment of the resulting GO for the purpose of reducing and re-graphitizing GO molecules. The heat treatment serves to chemically link GO molecules to form a 2-D or 3-D network of chemically bonded graphene molecules of essentially infinite molecular weights, and to drastically reduce the oxygen content of GO down to below 10% by weight, more typically <5%, further more typically <2%, and most typically <<1% (only trace amount if the heat treatment temperature is sufficiently high and heat treatment time sufficiently long).

For the preparation of the unitary graphene layer or graphene single crystal, the graphene oxide gel is composed of graphene oxide molecules dispersed in an acidic medium having a pH value of no higher than 5 and the graphene oxide molecules have an oxygen content no less than 20% by weight while in a gel state. The GO gel is obtained by immersing a graphitic material in a powder or fibrous form (e.g. natural or artificial graphite powder or graphite fibers) in an oxidizing liquid medium in a reaction vessel at a reaction temperature for a length of time sufficient to obtain a graphene oxide gel composed of graphene oxide molecules dispersed in the liquid medium. The graphene oxide molecules preferably and typically have an oxygen content no less than 20% by weight (typically 20%-46% by weight of oxygen) and a molecular weight less than 43,000 g/mole while in a gel state. Preferably, graphene oxide molecules have a molecular weight less than 4,000 g/mole while in a gel state, more preferably between 200 g/mole and 4,000 g/mole while in a gel state. The starting materials for the preparation of graphene oxide gel include a graphitic material selected from natural graphite, artificial graphite, meso-phase carbon, meso-phase pitch, meso-carbon micro-bead, soft carbon, hard carbon, coke, carbon fiber, carbon nano-fiber, carbon nano-tube, or a combination thereof. Additional description of the unitary graphene layer or graphene single crystal is available from one of our recent patent applications: Aruna Zhamu, Mingchao Wang, Wei Xiong, and Bor Z. Jang, "Unitary Graphene Layer or Graphene Single Crystal," U.S. patent application Ser. No. 13/694,356 (Nov. 26, 2012).

The unitary graphene layer or graphene matrix composite may be produced by depositing or dispensing a layer of graphene oxide gel or GO gel-filler mixture onto a surface of a substrate or into a mold cavity. The liquid component is then removed from this GO layer or the mixture layer of graphene oxide gel and the filler phase. This is followed by subjecting this layer to a heat treatment temperature of at least 100-150° C. for thermal reduction and/or re-graphitization. A good heat treatment temperature is from 500° C. to 1,500° C. for re-graphitization. Although not required, the heat treatment temperature may be higher than 1,500° C. for re-graphitization, or may be in the range of from 1,500° C. to 2,500° C. A temperature higher than 2,500° C. may be used if so desired.

In summary, this graphene oxide gel-derived graphene material, if reinforced with a filler or reinforcement phase (e.g. CNTs and carbon fibers), can make a unitary graphene matrix composite. (It may be noted that this composite contains GO-derived graphene as a matrix material, not as a reinforcement phase, and CNTs as a mechanical reinforcement material. Hence, this is a graphene matrix composite, not a graphene platelet-reinforced composite.) This composite is made by forming a mixture of the filler particles with the GO gel (e.g. by impregnating a CNT mat with the GO gel or by dispersing the CNTs in a GO gel to form a slurry), followed by removal of liquid from the gel and heat-treatment of the resulting GO-filler solid mixture (for the purpose of reducing and re-graphitizing GO molecules).

Other sheet-like carbon or graphitic materials that can be used as a thermal conductivity-enhancing phase include resin-free or resin-impregnated versions of carbon nano-tube (CNT) paper (e.g. Bucky paper), carbon fiber mat (e.g. carbon nano-fiber or CNF mat), and carbon paper (e.g. made of short carbon fibers). Although individual CNT or CNF filaments alone can exhibit a high thermal conductivity (1,500-3000 W/mK), the resulting CNT or CNF paper or mat (containing poorly aligned CNTs or CNFs) typically exhibit an in-plane thermal conductivity less than 100 W/mK and often less than 10 W/mK, likely due to the few and poor contacts between individual CNT or CNF filaments, or interruptions of electron flow paths. This can result in an ineffective heat transfer between the heat source and the functional portion of thawing tool. The heat transfer capability of these filament mats can be significantly improved by adding some graphene sheets to the composite.

The CNT or CNF mats or paper structures, if impregnated with a non-conducting resin (e.g. epoxy) for improved strength and rigidity, actually exhibit even lower thermal conductivity and lower electrical conductivity.

Another graphite material that can be used as a thermal conductivity-enhancing phase is the pyrolytic graphite film from carbonization and graphitization of a polymer, e.g. polyimide. The process begins with carbonizing a polymer film at a carbonization temperature of 500-1,000° C. for 2-10 hours to obtain a carbonized material, which is followed by a graphitization treatment at 2,500-3,200° C. for 1-24 hours to form a graphitic film.

A second type of pyrolytic graphite is produced by high temperature decomposition of hydrocarbon gases in vacuum followed by deposition of the carbon atoms to a substrate surface. This is essentially a chemical vapor deposition (CVD) process. In particular, highly oriented pyrolytic graphite (HOPG) is the material produced by the application of uniaxial pressure on deposited pyrocarbon or pyrolytic graphite at very high temperatures (typically 3,000-3,300° C.). This entails a thermo-mechanical treatment of combined mechanical compression and ultra-high temperature for an extended period of time in a protective atmosphere; a very expensive, energy-intensive, and technically challenging process. The process requires high vacuum and ultra-high temperature equipment that is not only very expensive to make but also very expensive and difficult to maintain. Even with such extreme processing conditions, the resulting PG (including HOPG) still possesses many defects, grain boundaries, and mis-orientations (neighboring graphene planes not parallel to each other), resulting in less-than-satisfactory in-plane properties. Typically, the best prepared HOPG sheet or block remains far from being a graphite single crystal; instead, it typically still contains many grains or single crystals and a vast amount of grain boundaries and defects. In general, the PG or HOPG is free from any element than carbon.

Similarly, the most recently reported graphene thin film (<2 nm) prepared by catalytic CVD of hydrocarbon gas (e.g. $C_2H_4$) on Ni or Cu surface is not a single-grain crystal, but a poly-crystalline structure with many grain boundaries and defects. With Ni or Cu being the catalyst, carbon atoms obtained via decomposition of hydrocarbon gas molecules at 800-1,000° C. are deposited onto Ni or Cu foil surface to form a sheet of single-layer or few-layer graphene that is poly-crystalline. The grains are typically much smaller than 100 μm in size and, more typically, smaller than 10 μm in size. This type of CVD graphene membrane may also be used as a conductivity-enhancing phase in the presently invented hand-held thawing tool.

Figure 2A:
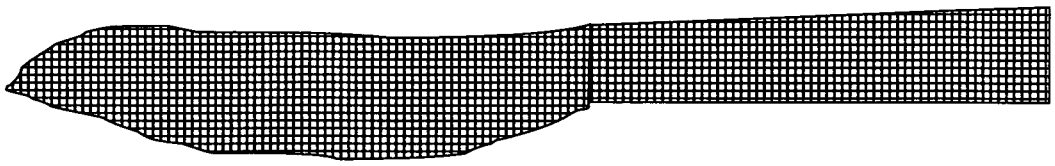
FIG. 2 (*a*) Schematic of a composite thawing tool wherein the graphene composite material essentially runs in the entire composite; (b) graphene or graphene composite constitutes a skin portion 14 of the thawing tool and the core portion 16 is relatively graphene-free or graphene composite-free; (c) graphene or graphene composite constitutes a core portion 19 of the thawing tool and the skin portion 18 is relatively graphene-free or graphene composite-free.
Figure 2B:
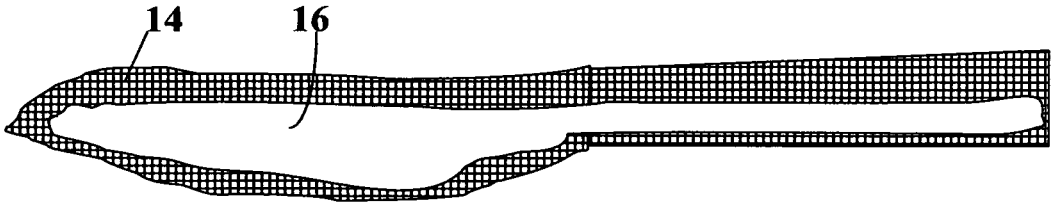
Figure 2C:
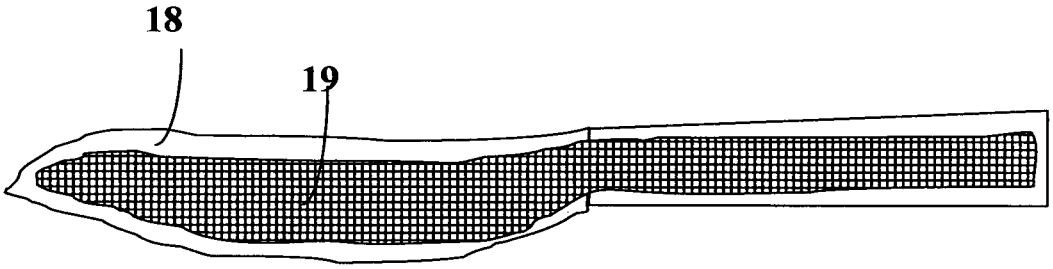

The above-described materials and processes enable us to produce various types of graphene composite tools for thawing a food item, such as butter or ice cube. Schematically shown in FIG. 2(*a*) is a composite thawing tool wherein the graphene composite material is present essentially in the entire composite. FIG. 2(*b*) shows a thawing tool wherein graphene or graphene composite constitutes a skin portion 14 of the thawing tool, but the core portion 16 is relatively graphene-free or graphene composite-free. This can be produced by, for instance, electro-plating or spray-depositing a layer of aluminum onto a graphene platelet-based mat or paper. In another possible design, as schematically shown in FIG. 2(*c*), the graphene or graphene composite material constitutes a core portion 19 of the thawing tool and the skin portion 18 is relatively graphene-free or graphene composite-free.

Instead of graphene, or in addition to graphene, one may choose to add a graphite or carbon material as a thermal conductivity-enhancing phase. Thus, the present invention also provides a hand-held and hand-heated thawing tool comprising a handling portion and a functional portion wherein one or both portions comprises a composite material comprising a conductivity-enhancing carbon or graphite phase (of 1-90% by weight) dispersed in or bonded by a matrix material (10-99% by weight based on a total composite weight). The handling portion, when being held by a human hand, transfers heat from the hand to the functional portion for thawing or melting an object. The carbon or graphite phase may be selected from the graphite particle, expanded graphite flake, flexible graphite sheet, pyrolytic graphite, carbon black, acetylene black, activated carbon, meso-phase carbon, needle coke, meso-phase carbon, carbon fiber, graphite fiber, carbon nano-fiber, graphitic nano-fiber, carbon nano-tube, a combination thereof, or a combination with a metal particle, metal fiber, or metal nano-wire. The matrix material may be selected from a metal, a polymer, a glass, a carbon, a ceramic material, or a combination thereof. The tool or composite material has a skin zone and a core zone and, in one possible design, the skin zone has a higher carbon or graphite proportion than said core zone. In an alternative design, the core zone may be primarily composed of a carbon or graphite material having a high thermal conductivity, but a thin layer of metal or plastic is deposited onto the surface surrounding the core zone to form a skin layer. The metal skin is preferably stainless steel or aluminum.

In order to determine the feasibility, advantages, and limitations of implementing graphene platelet-reinforced composite, graphene matrix composite, graphite particle-reinforced composite, carbon fiber-reinforced composite, or other thermally conductive composite in a hand-held and hand-heated thawing tool, we have conducted extensive thermal conductivity and thawing experiments that involve hundreds of samples. The results are summarized in Table 1, wherein the thawing tool is rectangular in shape (150 mm×15 mm×3 mm) unless otherwise specified.

TABLE 1

Summary of thawing test results (initial butter/margarine temperature was 5° C., ice cube was at −3° C., and room temperature was set at 22° C.).

| Sample Code | Thawing tool material | Object to be thawed | Hand-holding time (sec) | Temp. at thawing portion (° C.) | Thawing results |
|---|---|---|---|---|---|
| Cu-a | Cu | Butter | 5 | 27 | Some thawing |
| Cu-b | Cu | Butter | 10 | 29 | Fair |
| Cu-Gn-a | Cu-plated unitary graphene (Gn) | Butter | 5 | 32 | Good thawing |
| Cu-Gn-b | Cu-plated unitary graphene (Gn) | Butter | 10 | 34 | Full thawing |
| Cu-CNF | Cu-plated CNF | Butter | 10 | 31 | Good thawing |
| SS-a | Stainless steel | Butter | 15 | 25 | No thawing |
| SS-b | Stainless steel | Butter | 60 | 26 | No thawing |
| SS-c | Stainless steel | Ice cube | 60 | 26 | No thawing; could not cut through cube |
| Al-a | Aluminum | Butter | 15 | 25 | No thawing |
| Al-b | Aluminum | Ice cube | 15 | 25 | No thawing; could not cut through cube |
| Al-Gn-a | NGP-reinforced Al (discrete graphene platelets = reinforcement) | Butter | 10 | 32 | Good thawing |
| Al-Gn-b | Al skin/NGP core | Butter | 10 | 33 | Good thawing |
| Al-Gn-c | Al skin/NGP core | Ice cube | 15 | 34 | Easily cutting through ice cube |
| Ph-Gn-a | Phenolic resin-impregnated NGP mat | Butter | 10 | 32 | Good thawing |
| Ph-b | Phenolic resin | Butter | 30 | 22 | No thawing |
| Ph-EGr-c | Phenolic-impregnated expanded graphite mat | Butter | 10 | 30 | Fair-to-good thawing |
| Ph-CNF-d | Phenolic-impregnated CNF mat | Butter | 10 | 29 | Fair |
| Ph-CNT-e | Phenolic-impregnated CNT mat | Butter | 10 | 29 | Fair |
| Ph-Gn/CB-f | Phenolic-impregnated graphene/CB mixture mat | Margarine | 10 | 31 | Good thawing |
| Ph-CNF/CB-g | Phenolic-impregnated CNF/CB mixture mat | Margarine | 10 | 29 | Fair |
| C-a | Carbon (pyrolyzed phenolic) | Margarine | 10 | 23 | No thawing |
| C-Gn-b | Graphene-reinforced carbon matrix | Margarine | 10 | 29 | Fair |
| C-CNF-c | CNF-reinforced carbon matrix | Margarine | 10 | 28 | Some thawing |

Several observations can be made from the data summarized in Table 1:

(1) Graphene-free and graphite filler-free metal-based tools (e.g. stainless steel or aluminum table knives as denoted by Samples SS-a, SS-b, SS-c, Al-a, and Al-b) and polymer-based tools (e.g. Sample Ph-b) are not an effective heat transfer medium, incapable of transporting heat from a human hand to thaw a food item such as butter.

(2) The presence of a proper amount of graphene or other type of carbon/graphite filler as a thermal conductivity enhancer in a matrix material makes a good thawing tool, capable of rapidly transferring human hand-generated heat to the functional portion of the tool to thaw a food item. This is truly unexpected.

(3) Graphene, in the form of nano graphene platelets (NGPs), is significantly more effective than the CNF or CNT in accelerating the transfer of heat from one portion to another portion of a thawing tool with significantly reduced heat loss.

(4) Unitary graphene (or graphene single crystal prepared from graphene oxide gel), when electro-plated with a thin layer of copper, provides the best performance as a thawing tool material.

(5) Combined features of faster heat transfer and reduced heat loss seem to have qualified graphene as the very best thawing tool material.

(6) Also quite surprisingly, expanded graphite flakes are more effective than CNFs and CNTs in promoting heat transfer and reducing heat loss. This is shown in Sample Ph-EGr-c vs. Ph-EGr-d and Ph-EGr-e.

The invention claimed is:

1. A piece of hand-held thawing tableware comprising a handling portion and a functional portion wherein one or both portions comprises a composite material comprising 1-90% by weight of a conductivity-enhancing graphene phase dispersed in or bonded by a matrix material of 10-99% by weight based on a total composite weight, wherein said graphene phase has a platelet morphology and has a thermal conductivity from 1,000 W/mK to 1,800 W/mK and contains a graphene material selected from platelets or sheets of pristine graphene, graphene oxide, reduced graphene oxide, doped graphene, nitrogenated graphene, hydrogenated graphene, halogenated graphene, CVD graphene, functionalized graphene, or a layer of unitary graphene or graphene single crystal, or a combination thereof and wherein said matrix material is selected from a metal, a polymer, a carbon, or a combination thereof, wherein said handling portion, adapted to transfer heat when held, transfers heat to said functional portion for thawing or melting an object.

2. The piece of hand-held thawing tableware of claim 1, wherein said composite material has a thermal conductivity greater than 300 W/mK.

3. The piece of hand-held thawing tableware of claim 1, wherein said composite material has a thermal conductivity greater than 500 W/mK.

4. The piece of hand-held thawing tableware of claim 1, wherein said composite material has a thermal conductivity greater than 1,000 W/mK.

5. The piece of hand-held thawing tableware of claim 1, wherein said matrix material comprises steel, aluminum, copper, zinc, or tin.

6. The piece of hand-held thawing tableware of claim 1, wherein said functional portion is configured to reach a temperature of at least 30° C. when said handling portion is held, by a human hand for 10 seconds or less.

7. The piece of hand-held thawing tableware of claim 1, wherein said functional portion is configured to reach a temperature of at least 34° C. when said handling portion is held by a human hand for 10 seconds or less.

8. The piece of hand-held thawing tableware of claim 1, wherein said functional portion is configured to reach a temperature sufficient to thaw said object when said handling portion is held by a human hand for 10 seconds or less.

9. The piece of hand-held thawing tableware of claim 1, wherein said functional portion is configured to reach a temperature sufficient to thaw said object when said handling portion is held by a human hand for 5 seconds or less.

10. The piece of hand-held thawing tableware of claim 1, wherein said composite material has a skin zone and a core zone and said skin zone is a graphene-rich zone having a higher graphene proportion than said core zone.

11. The piece of hand-held thawing tableware of claim 1, wherein said composite material has a skin zone and a core zone and said skin zone is a graphene-poor zone having a lower graphene proportion than said core zone.

12. The piece of hand-held thawing tableware of claim 1, wherein said composite material further comprises a thermally conductive additive selected from a graphite particle, expanded graphite flake, flexible graphite sheet, pyrolytic graphite, carbon black, acetylene black, activated carbon, meso-phase carbon, needle coke, carbon fiber, graphite fiber, carbon nano-fiber, graphitic nano-fiber, carbon nano-tube, metal particles, metal fiber, metal nano-wire, or a combination thereof.

13. A piece of hand-held thawing tableware comprising a handling portion and a functional portion wherein one or both portions comprises a composite material comprising 1-90% by weight of a conductivity-enhancing graphene phase dispersed in or bonded by a matrix material of 10-99% by weight based on a total composite weight, wherein said graphene phase has a platelet morphology and has a thermal conductivity from 1,000 W/mK to 1,800 W/mK and is selected from platelets or sheets of pristine graphene, graphene oxide, reduced graphene oxide, doped graphene, nitrogenated graphene, hydrogenated graphene, halogenated graphene, CVD graphene, functionalized graphene, or a layer of unitary graphene or graphene single crystal, or a combination thereof and wherein said matrix material is selected from a glass material and a ceramic material, wherein said handling portion, adapted to transfer heat when held, transfers heat to said functional portion for thawing or melting an object.

* * * * *